US008205392B2

(12) United States Patent
Balbo Di Vinadio

(10) Patent No.: US 8,205,392 B2
(45) Date of Patent: Jun. 26, 2012

(54) METHOD FOR MOUNTING AN AUXILIARY MEMBER ON A DOOR OR WINDOW FRAME

(75) Inventor: Aimone Balbo Di Vinadio, Chiusa San Michele (IT)

(73) Assignee: Savio S.P.A., Torino (IT)

( * ) Notice: Subject to any disclaimer, the term of this patent is extended or adjusted under 35 U.S.C. 154(b) by 910 days.

(21) Appl. No.: 11/763,152

(22) Filed: Jun. 14, 2007

(65) Prior Publication Data

US 2008/0016782 A1 Jan. 24, 2008

(51) Int. Cl.
*E06B 3/00* (2006.01)

(52) U.S. Cl. ..... 49/506; 49/192; 49/193; 292/32; 292/43

(58) Field of Classification Search ..... 49/192, 49/193, 382, 506, 400; 292/32, 38, 42, 43, 292/141, 145, 150; 411/393, 387.1–387.8
See application file for complete search history.

(56) References Cited

U.S. PATENT DOCUMENTS

| | | | | | |
|---|---|---|---|---|---|
| 2,479,730 | A | * | 8/1949 | Dewar | 411/387.4 |
| 2,654,284 | A | * | 10/1953 | Schevenell | 411/387.4 |
| 2,840,201 | A | * | 6/1958 | Anderson | 52/217 |
| 3,156,152 | A | * | 11/1964 | Reed | 411/386 |
| 3,517,581 | A | * | 6/1970 | Stokes et al. | 411/387.8 |
| 4,538,947 | A | * | 9/1985 | Burkholder | 411/393 |
| 4,541,200 | A | * | 9/1985 | Gartner | 49/192 |
| 4,624,075 | A | * | 11/1986 | Vigreux | 49/192 |
| 4,637,165 | A | * | 1/1987 | Schneider | 49/192 |
| 4,833,825 | A | * | 5/1989 | Sprung | 47/62 C |
| 5,076,015 | A | * | 12/1991 | Manzalini | 49/192 |
| 5,226,256 | A | * | 7/1993 | Fries et al. | 49/13 |
| 7,017,301 | B2 | * | 3/2006 | Balbo Di Vinadio | 49/192 |
| 7,340,860 | B2 | * | 3/2008 | Balbo Di Vinadio | 49/192 |

FOREIGN PATENT DOCUMENTS

| | | |
|---|---|---|
| EP | 1 227 207 | 7/2002 |
| EP | 1 447 505 | 8/2004 |

OTHER PUBLICATIONS

EP Search Report, Application No. EP 07 10 8493, dated Sep. 28, 2007.

* cited by examiner

*Primary Examiner* — Katherine W Mitchell
*Assistant Examiner* — Catherine A Kelly
(74) *Attorney, Agent, or Firm* — Patterson & Sheridan, LLP

(57) ABSTRACT

A method for mounting an auxiliary member on a window or door frame already installed and whereon is mounted a drive assembly comprising at least one actuating member and at least one transmission rod mounted in at least one slot of the frame. The method comprises the steps of, providing, between the auxiliary member and the rod, a coupling that is slidable in a longitudinal direction and fixed in any direction orthogonal to the direction of sliding, and forming a through hole in the rod by a screw carried by the auxiliary member, and fastening the auxiliary member to the rod by the engagement of a tip of the screw with the through hole.

8 Claims, 21 Drawing Sheets

METHOD FOR MOUNTING AN AUXILIARY MEMBER ON A DOOR OR WINDOW FRAME

CROSS-REFERENCE TO RELATED APPLICATIONS

This application claims benefit of Italian patent application number TO2006A000434, filed Jun. 15, 2006, which is herein incorporated by reference.

BACKGROUND OF THE INVENTION

1. Field of the Invention

The present invention relates to accessories for door and window frames and it pertains to a method for mounting an auxiliary member on a door or window already installed.

2. Description of the Related Art

A door or window comprises a frame and a drive assembly constituted by the devices and components that enable to transmit the opening/closing motion from the handle to various closure elements. The devices and components of the drive assembly are mounted, regulated and fastened to the frame when installing the window or door.

In some cases, after the window or door is installed, it is necessary to add an auxiliary member to the window or door. For example, it can be necessary to add one or more additional closure members to enhance the security of the closure.

In prior art solutions, the addition of auxiliary members in a window or door already installed is a long and complex operation, that entails cutting one or more transmission rods to measure and forming holes on the rods for fastening the auxiliary members. These operations require equipment available in the workshops of the manufacturers but that is not easily transportable on the site where the window or door is installed.

SUMMARY OF THE INVENTION

The object of the present invention is to provide a method for mounting an auxiliary member on a window or door already installed, that is simple and does not require the use of special equipment.

According to the present invention, said object is achieved by a method having the characteristics set out in claim 1.

BRIEF DESCRIPTION OF THE DRAWINGS

The present invention shall now be described in detail with reference to the accompanying drawings provided purely by way of non limiting example, in which.

DETAILED DESCRIPTION

Figure 1:
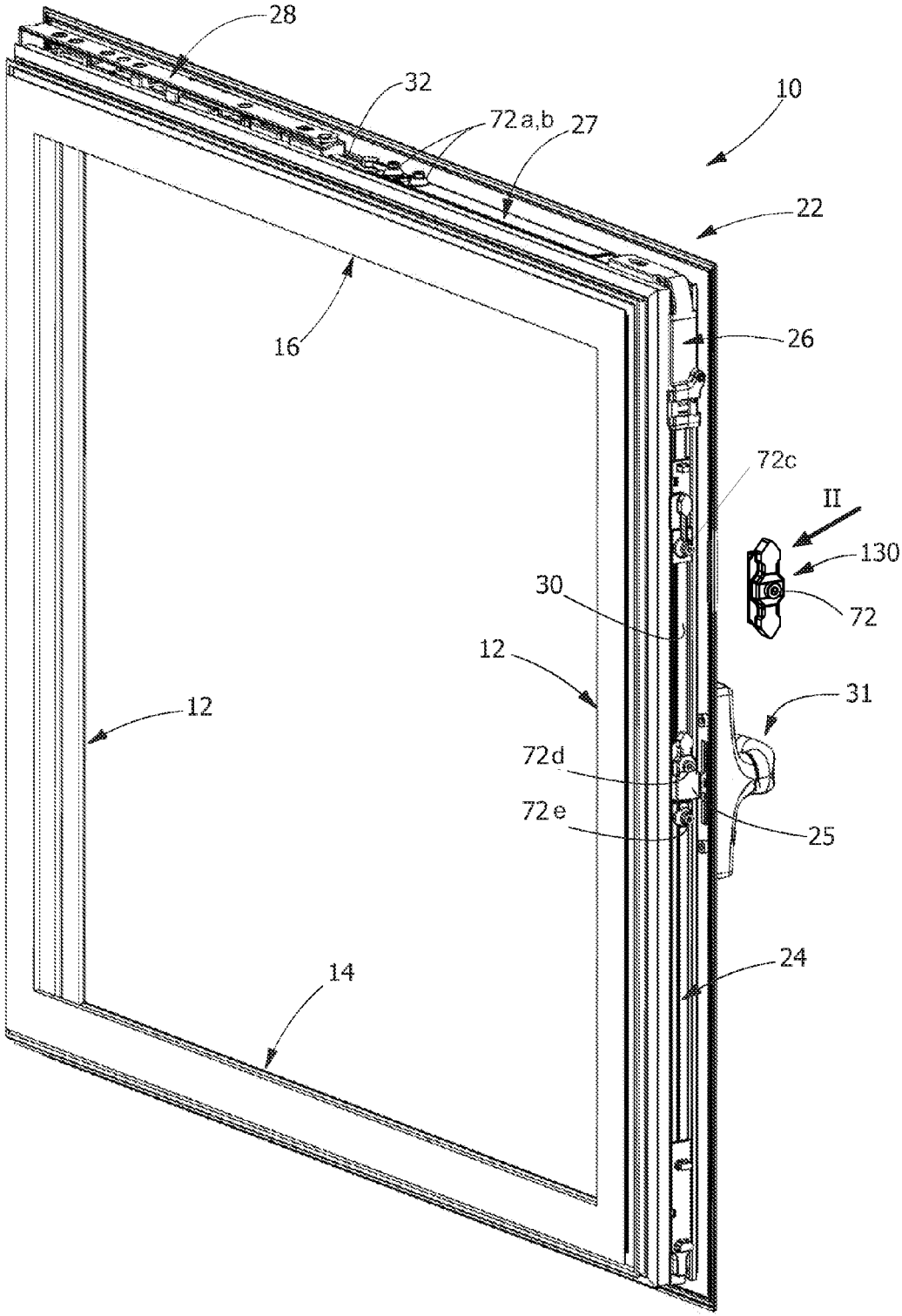
FIG. 1 is a perspective view of a window or door whereon an auxiliary member is to be mounted.

With reference to FIG. 1, the number 10 designates the frame of a tilt-and-turn opening window. The frame 10 comprises two vertical uprights 12 joined together by a lower cross member 14 and by an upper cross member 16. The uprights 12 and the cross members 14, 16 are provided on their outer longitudinal side with slots 18, 20 (FIG. 2) able to receive the components of a drive assembly 22 that enables to select, by means of a handle 31, a closed position, a turn opening position and a tilt opening position.

The drive assembly 22 comprises a plurality of actuating members 24, 25, 26, 27, 28, and a plurality of transmission rods 30, 32. The actuating members shown in FIG. 1 are, respectively, a vertical fulcrum 24, a cremone bolt 25, an angled transmission element 26, a cursor 27 and a scissors arm 28. The frame 10 is also provided with a control handle 31. The general structure and the operation of the actuating members 24, 25, 26, 27, 28 are known in themselves and they are outside the scope of the present invention.

The actuating members 24, 25, 26, 27, 28 are mounted on the frame 10 as described in a contemporaneous patent application by the same applicant with the title: "A method for mounting a drive assembly for door and window frames".

Figure 2:
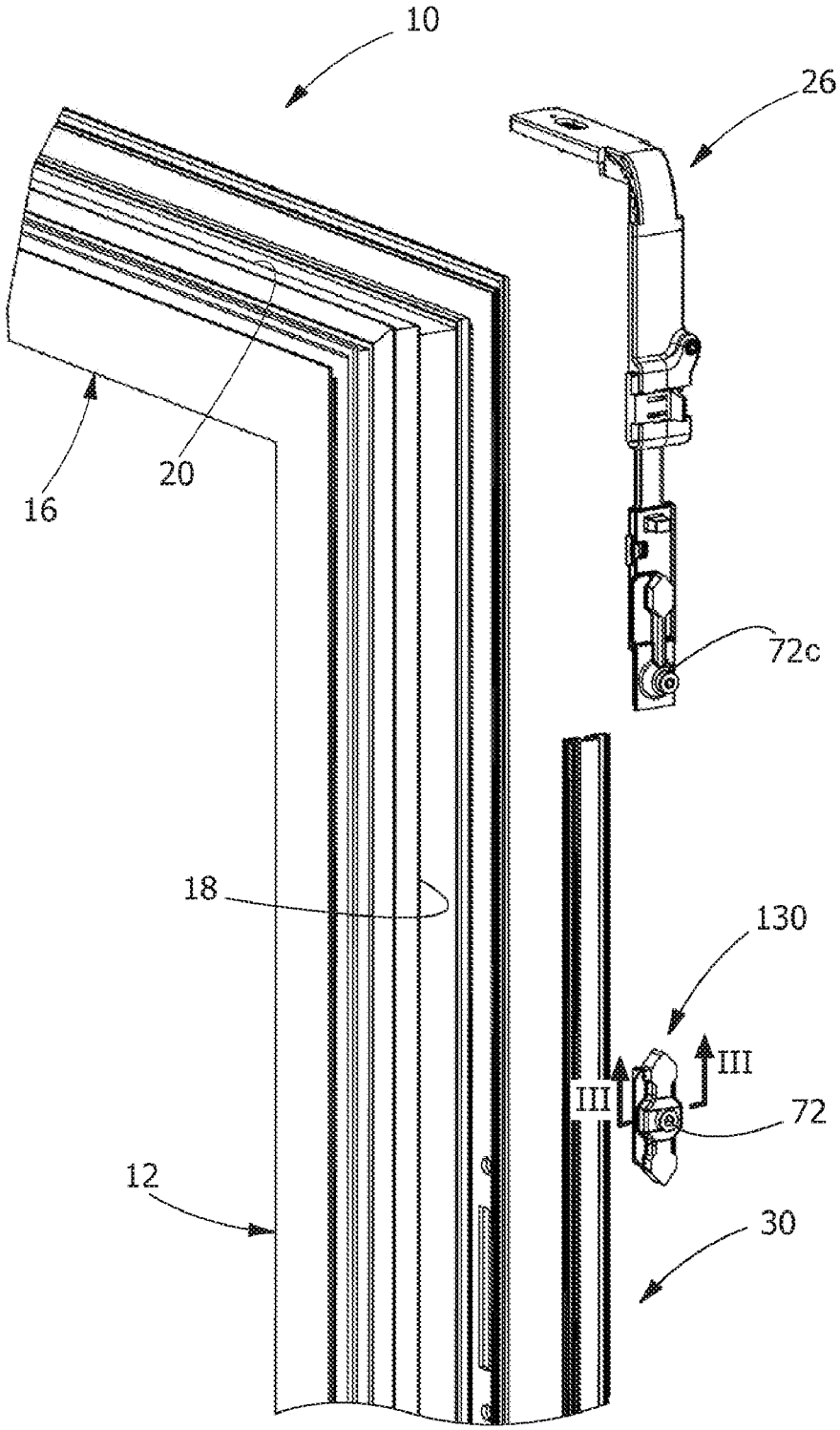
FIG. 2 is a perspective view of the part designated by the arrow II in FIG. 1.

With reference to FIGS. 1 and 2, the number 130 designates an auxiliary member to be mounted on the frame 10 after the actuating members 24, 25, 26, 27, 28 have already been mounted definitively on the frame 10.

The auxiliary member 130 is for example constituted by a closure member destined to co-operate with an abutment (not shown) fastened to the fixed frame of the window or door. The auxiliary member 130 is destined to be mounted on one of the transmission rod 30, 32.

Figure 4:
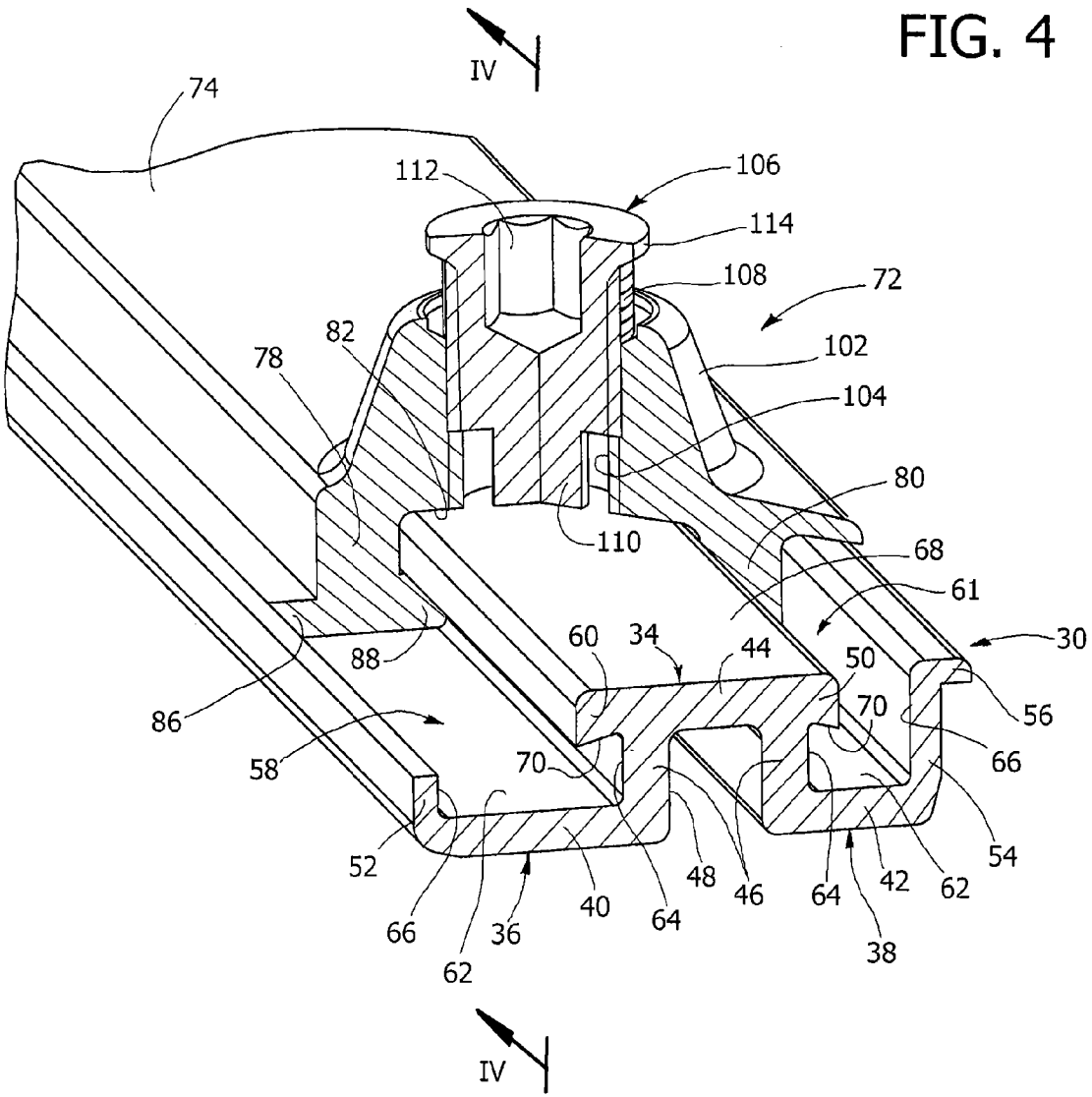
FIGS. 4*a* and 5*a* are sections according to the lines IV-IV and V-V of FIGS. 4 and 5, FIGS. 4*b* and 5*b* are enlarged details of the parts indicated by the arrows IV and V in FIGS. 4*a* and 5*a*, FIGS. 6*a*, 7*a* and 8*a* are sections according to the lines VIa-VIa, VIIa-VIIa and VIIIa-VIIIa of FIGS. 6, 7 and 8, FIGS. 6*b*, 7*b* and 8*b* are sections according to the lines VIb-VIb, VIIb-VIIb, VIIIb-VIII of FIGS. 6, 7 and 8, and FIGS. 9 through 16 are perspective views showing the mounting sequence of an auxiliary member on a window or door whereon a drive assembly has already been previously mounted.
Figure 4B:
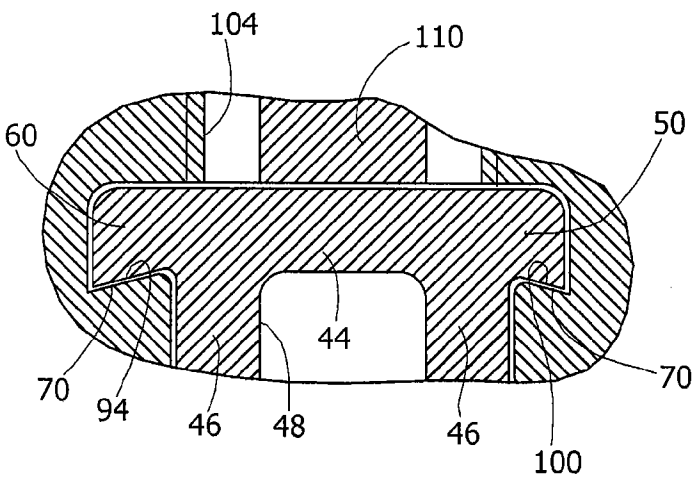
Figure 4A:
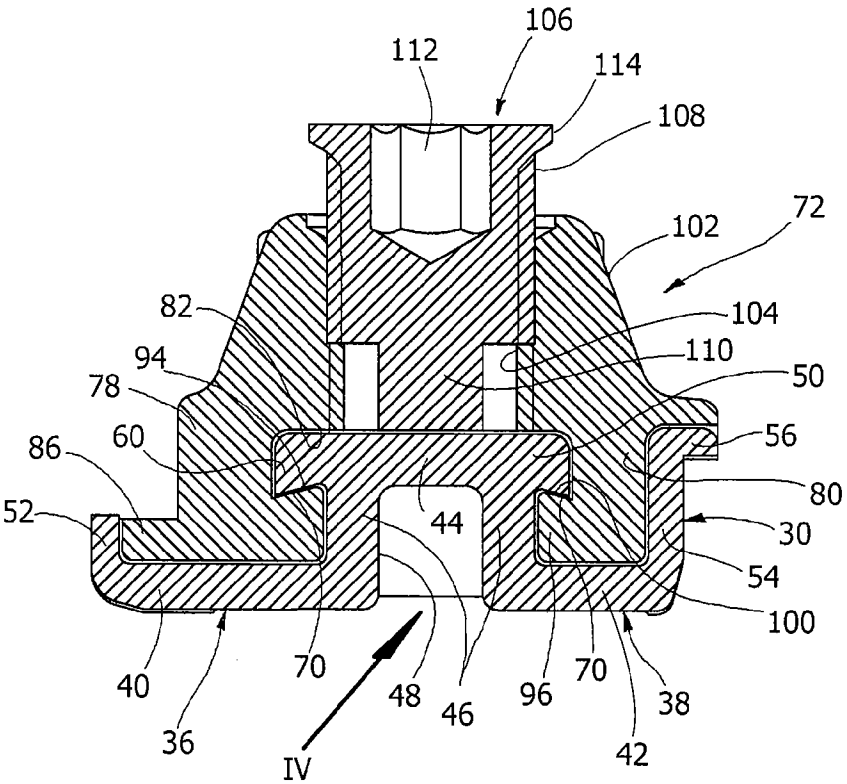

As shown in FIGS. 4 and 4*a*, each transmission rod is constituted by an extruded, drawn or profiled element having constant cross section along its own longitudinal axis.

Each transmission rod 30, 32 comprises a central portion 34 and two lateral portions 36, 38 situated at opposite parts relative to the central portion 34. The two lateral portions 36, 38 have respective mutually co-planar bases 40, 42. The central portion 34 has a base 44 that is parallel and distanced from the bases 40, 42 of the lateral portions 36, 38. The base 44 of the central portion 34 is connected to the respective bases 40, 42 of the lateral portions 36, 38 by means of two longitudinal ribs 46. The base 44 of the central portion 34 and the ribs 46 form a "U" shaped longitudinal groove 48 that extends along the central portion 34 and that separates the two lateral portions 36, 38. The central portion 34 has two lateral extensions 50 and 60 that extend exteriorly beyond the ribs 46. The two bases 40, 42 of the lateral portions 36, 38 have at their outer ends respective longitudinal ribs 52, 54. The height of the rib 52 of the lateral portion 36 is about half the height of the ribs 46. The rib 54 of the lateral portion 38 ends at the same height as the base 44 of the central portion 34 and it has a laterally projecting edge 56.

The two lateral portions 36, 38 form respective channel-shaped guides 58, 61. Each of the two guides 58, 61 has an upper surface 62 and two lateral surfaces 64, 66. The central portion 34 has an upper surface 68 that is parallel to the upper surfaces 62 of the guides 58, 61. The lateral extensions 50, 60 of the central portion 34 have lower surfaces 70 inclined at an acute angle relative to the lateral surfaces 64 of the ribs 46.

The thickness of the bases 40, 42 of the lateral portions 36, 38 of the ribs 46 and of the base 44 of the central portion 34 is substantially constant. The rods 30, 32 are preferably made of metallic material (e.g., aluminium alloy) or plastic material (e.g., polyamide).

Figure 3:
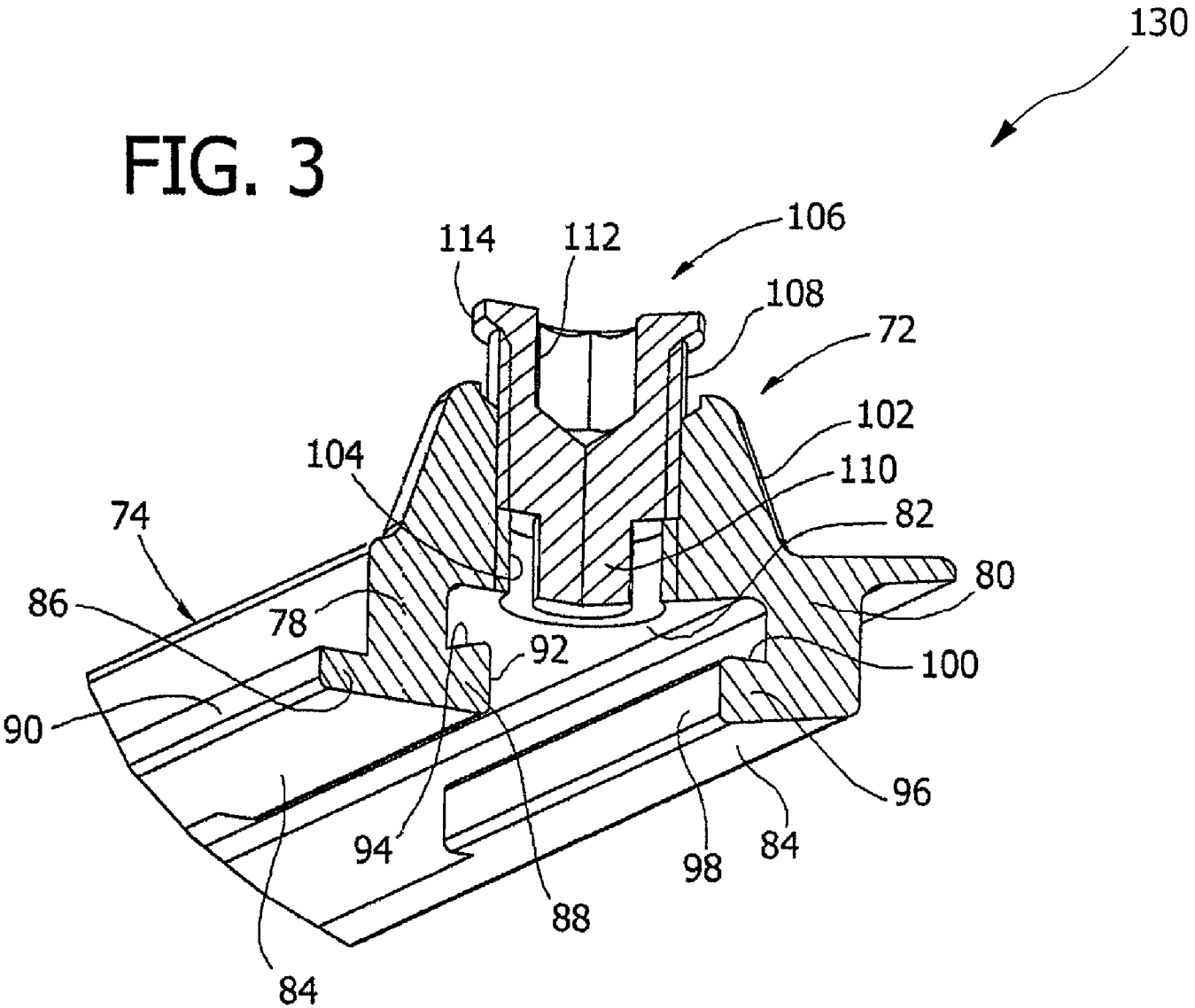
FIG. 3 is a section in enlarged scale according to the line III-III of FIG. 2, FIGS. 4 through 8 are perspective views showing the sequence of the fastening operation between the auxiliary member and a transmission rod.

With reference to FIG. 3, the auxiliary member 130 has a coupling portion 72 for coupling with the transmission rod 30, 32. Similar coupling portions 72*a-e* (shown in FIGS. 1-2) are provided on each actuating member 24, 25, 26, 27, 28. Each coupling portion 72 comprises a body 74 wherefrom project two parallel longitudinal ribs 78, 80. The ends of the longitudinal ribs 78, 80 are shaped in such a way as to establish a sliding coupling in longitudinal direction with the guides 58, 61 of the transmission rod 30, 32 and fastened in any direction orthogonal to the direction of sliding.

With reference to FIG. 3, the coupling portion 72 has a flat lower surface 82 wherefrom extend the ribs 78, 80. The lower ends of the ribs 78, 80 have respective coplanar flat surfaces 84, parallel to the flat surface 82. When cross sectioned, the longitudinal rib 78 has at its end an outer lateral extension 86 and an inner lateral extension 88. The two lateral extensions 86, 88 have respective lateral parallel walls 90, 92, orthogonal relative to the surfaces 82, 84. The inner lateral extension 88 has an upper surface 94 inclined at an acute angle relative to the lateral wall 92. The longitudinal rib 80 has, in cross section, an inner lateral extension 96 with a lateral wall 98 parallel to the wall 92 and an upper surface 100 inclined at an acute angle relative to the lateral wall 98.

The coupling portion 72 of the auxiliary member 130 has a section 102 provided with a threaded through hole 104 with orthogonal axis relative to the inner surface 82 of the body 74. A screw 106 is engaged in the threaded hole 104. The screw 106 has a threaded body 108 and a tip 110 that projects from the threaded body 108. The tip 110 has a cylindrical lateral wall with a smaller diameter than the diameter of the threaded body 108. The tip ends with a flat wall orthogonal to the longitudinal axis of the screw.

The screw 106 has a hexagonal slot 112 and an arresting edge 114 at one end of the threaded body 108. The length of the threaded body 108 is substantially equal to the length of the threaded hole 104, so that when the screw 106 is completely screwed into the hole 104 the tip 110 projects from the lower surface 82 of the body 74.

With reference to FIGS. 4, 4*a* and 4*b*, the coupling portion 72 of each auxiliary member 130, 30 couples in sliding fashion on the transmission rod 30. At the time of the coupling between the auxiliary member 130 and the transmission rod 30, the screw 106 is only partially screwed into the hole 104 and the front end of the tip is recessed in the hole 104 relative to the lower surface 82 of the coupling portion 72. The coupling portion 72 and the transmission rod 30 are therefore free to slide with respect to one another in longitudinal direction. To allow telescopic sliding between the two components, the respective cross-sections are so dimensioned as to leave a constant play along the entire cross-section, e.g. in the order of 0.1 mm, as shown in particular in FIGS. 4*a* and 4*b*.

Hereafter, the sequence will be described for the mounting of the auxiliary member 130 starting from the configuration in which the actuating members 24, 25, 26, 27 and 28 are already mounted on the frame 10.

Figure 9:
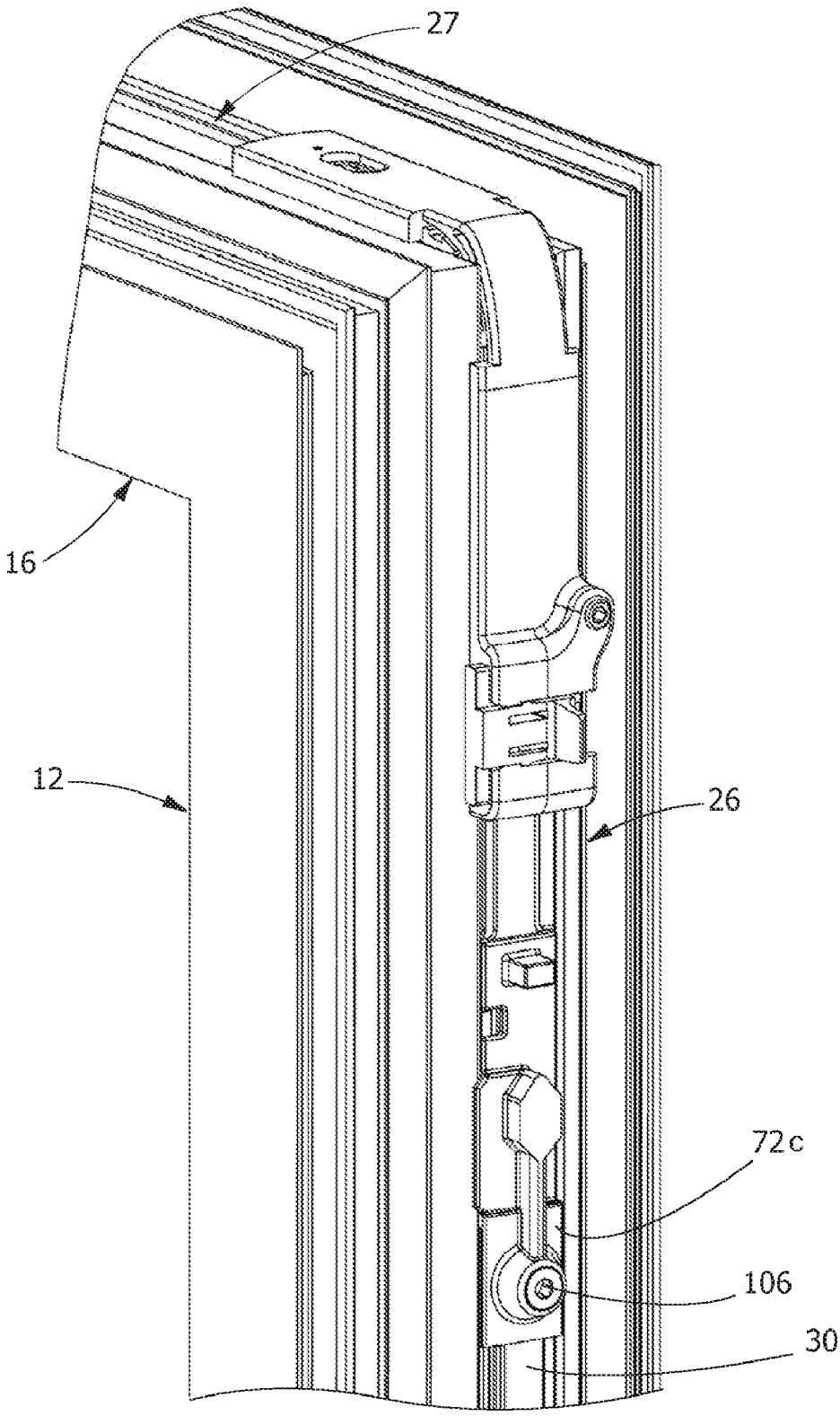

With reference to FIG. 9, the angled transmission element 26 is provided with a coupling portion 72*c* similar to the coupling portion 72 of the auxiliary member 130 described above. The coupling portion 72*c* is provided with a screw 106 that engages a through hole of the transmission rod 30. In the configuration of FIG. 9, the screw 106 is screwed all the way and the transmission rod is connected to the angled transmission element.

Figure 10:
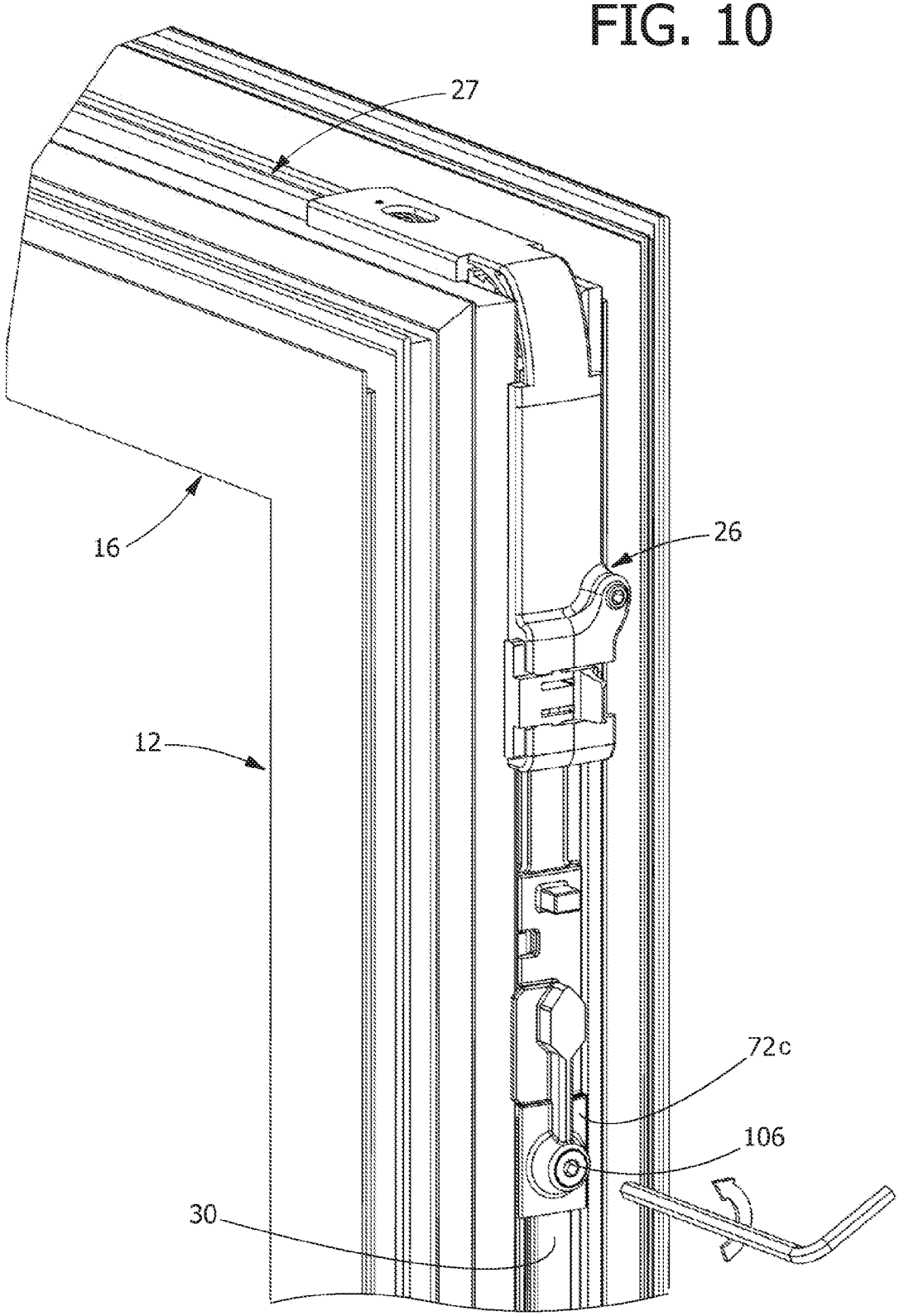

To mount the auxiliary member 130, the screw 106 of the angled transmission element 26 (FIG. 10) is unscrewed.

Figure 11:
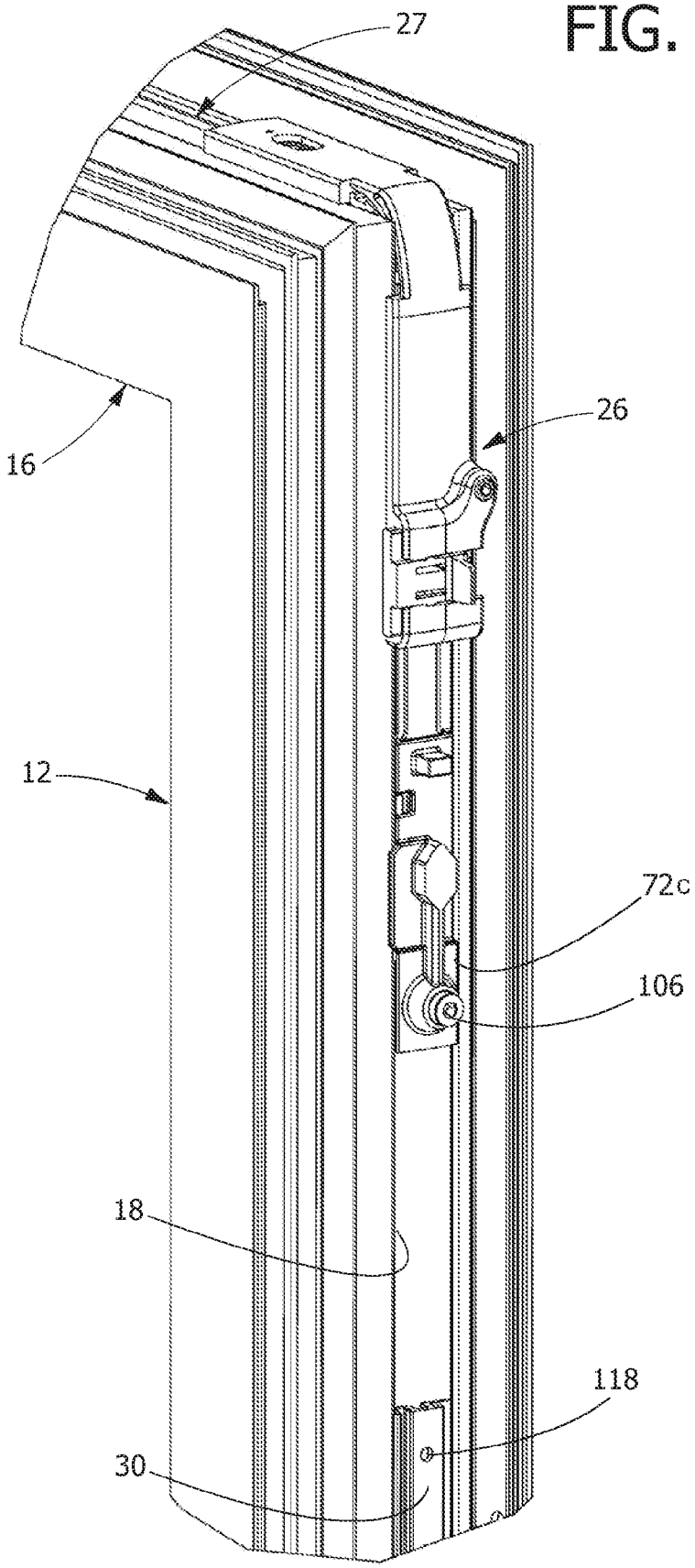

Hence, as shown in FIG. 11, the transmission rod 30 is made to slide downwards within the slot 18 of the upright 12, in such a way as to leave a free space in the slot 18 between the upper end of the rod 30 and the lower end of the angled transmission element 26.

Figure 12:
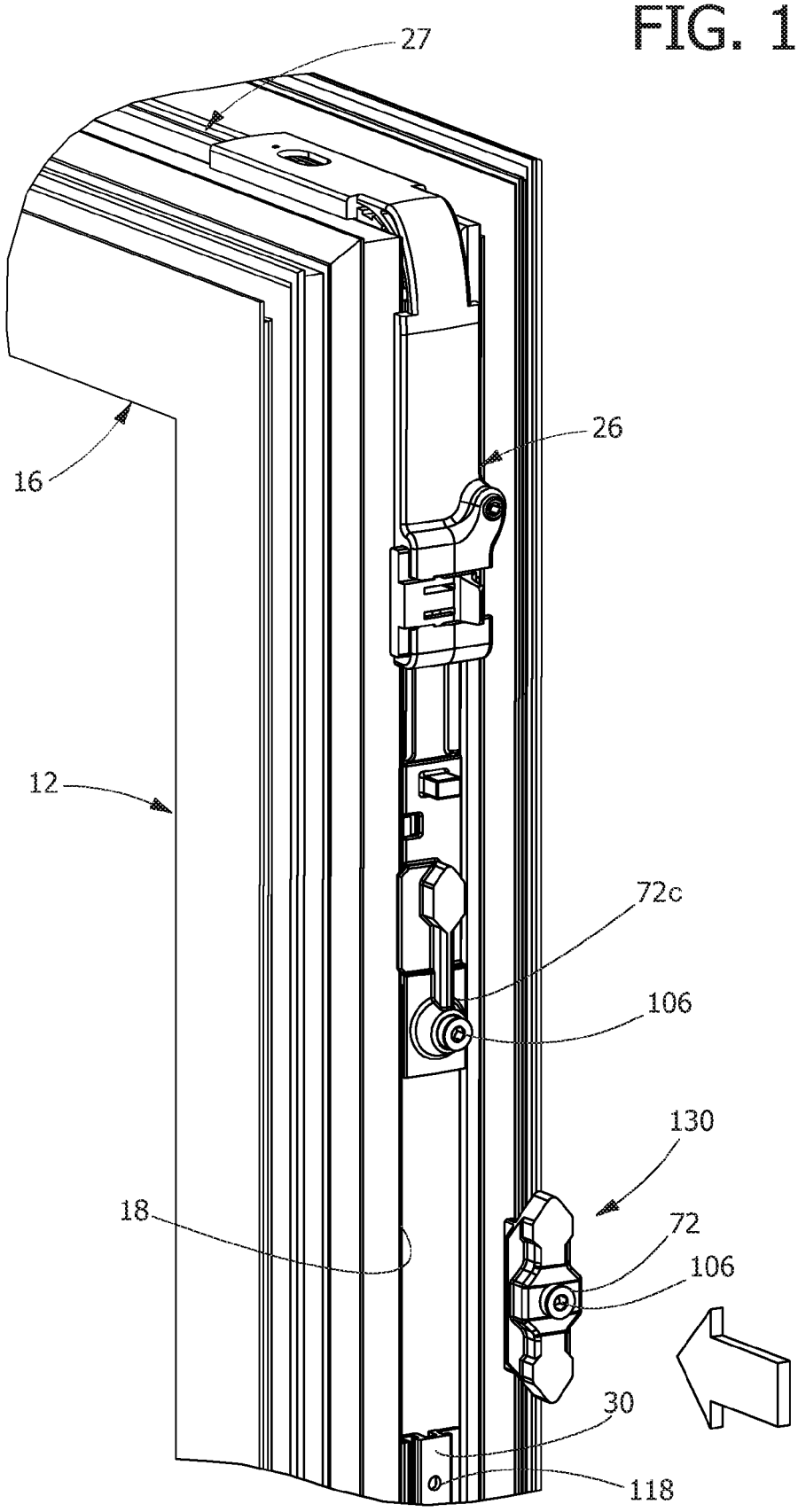

With reference to FIG. 12, the auxiliary member 130 is then inserted into the slot 18 of the upright 12 in the direction of the arrow.

Figure 13:
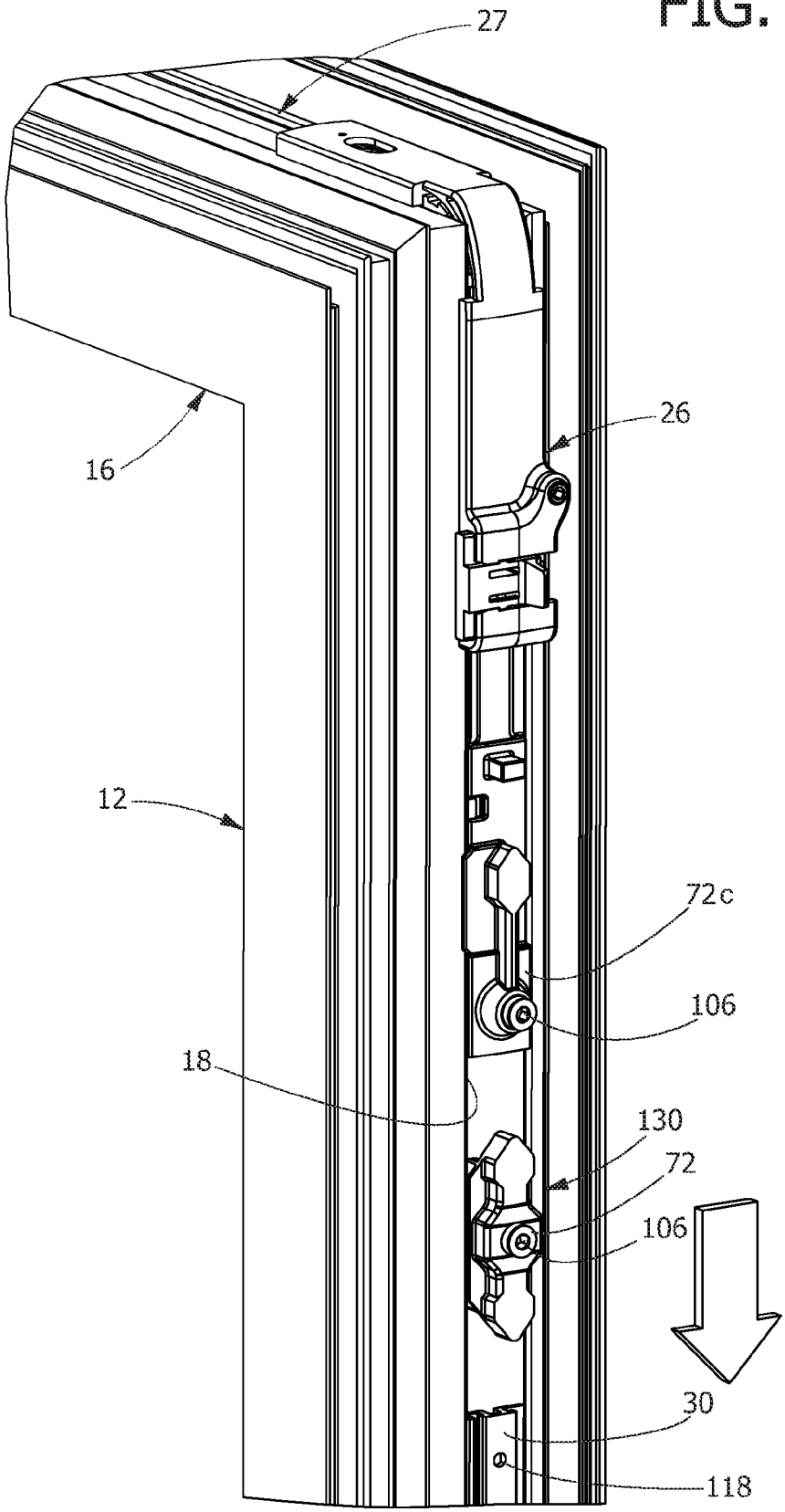

As shown in FIG. 13, after insertion into the slot 18 the auxiliary member 130 is made to slide longitudinally along the direction of the arrow.

Figure 14:
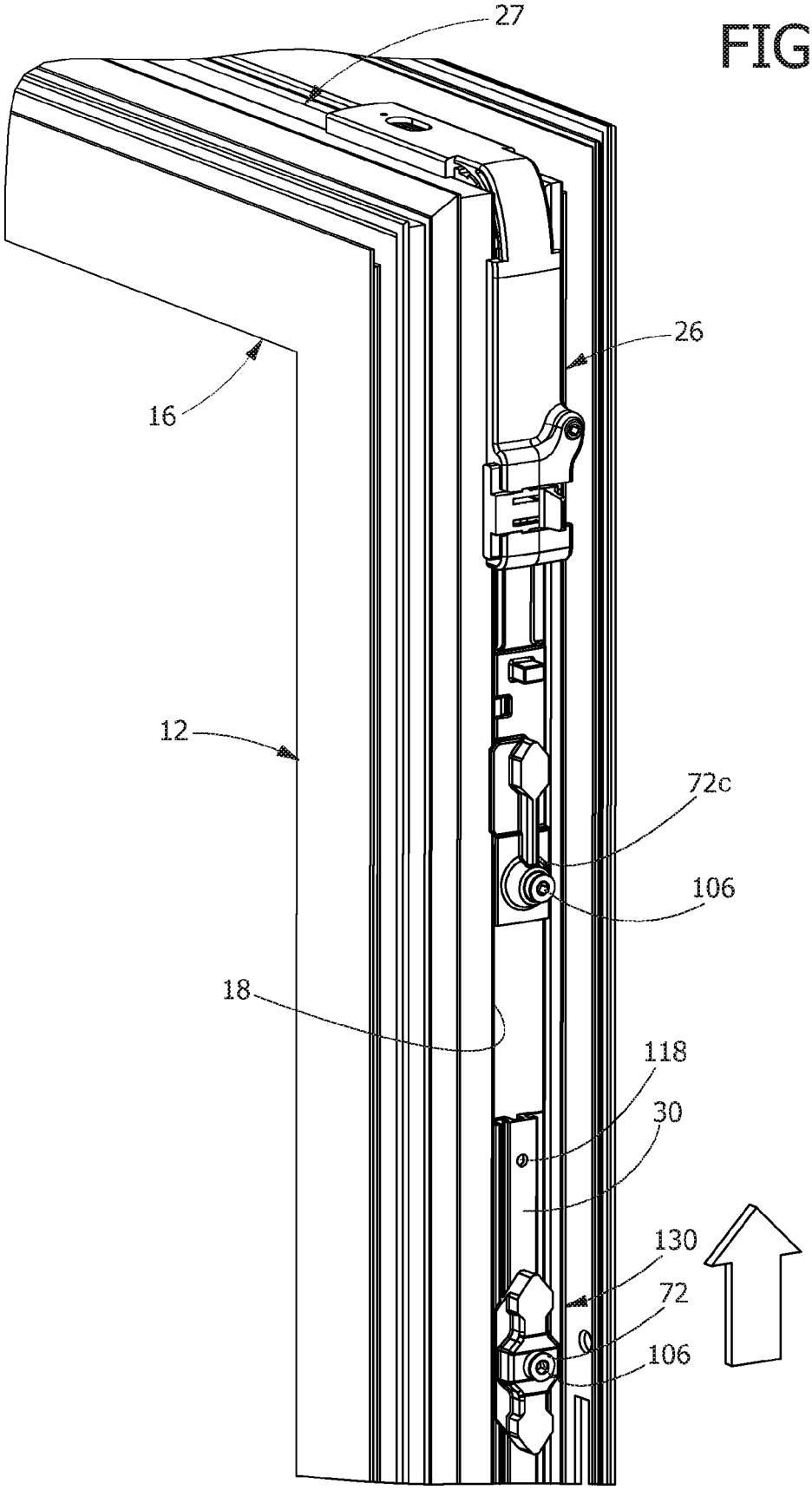

With reference to FIG. 14, by effect of the movement in the longitudinal direction, the auxiliary member 130 couples with the rod 30. At this point, the rod is made to slide upwards (in the direction indicated by the arrow) within the slot 18.

Figure 15:
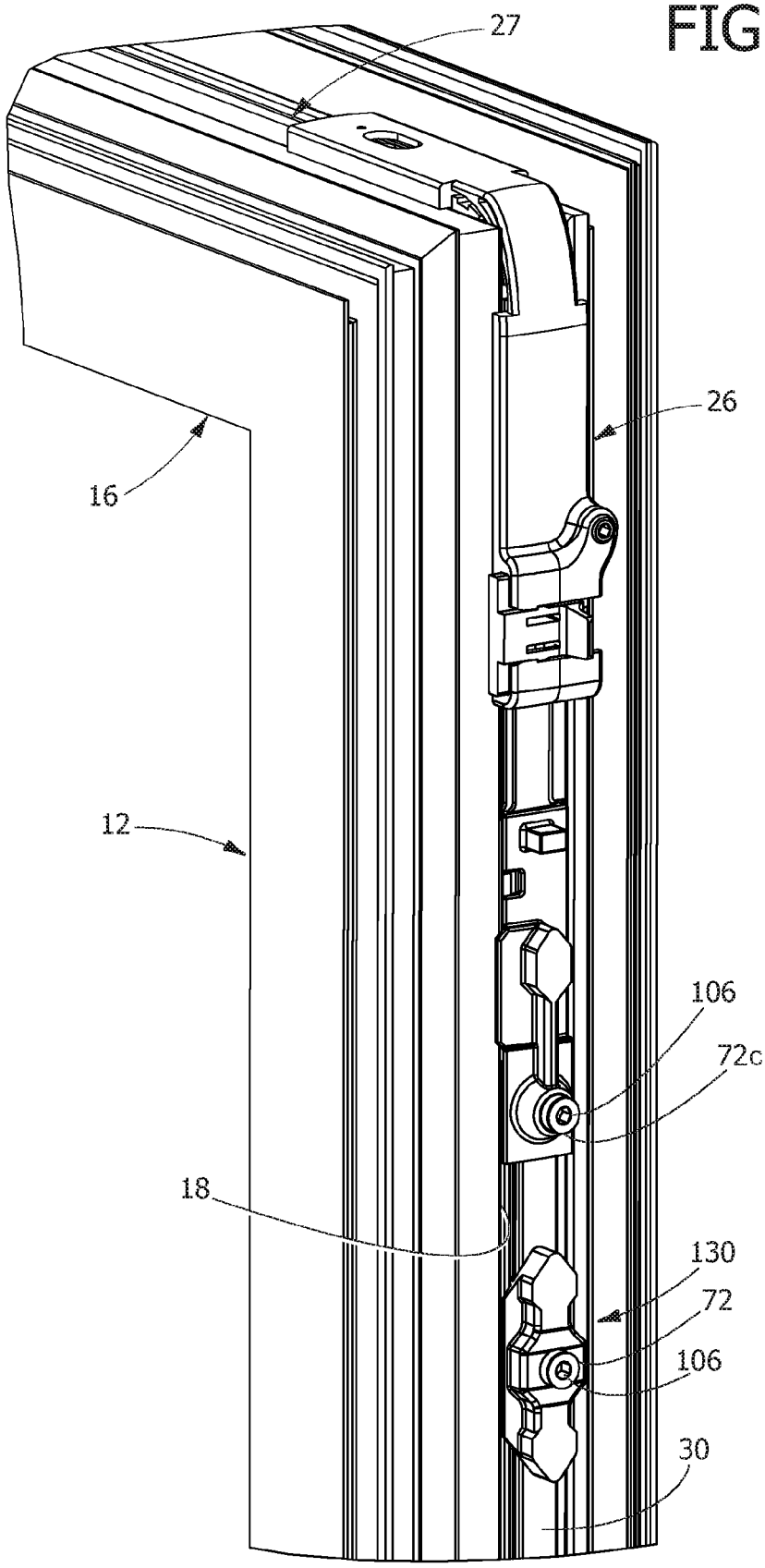

With reference to FIG. 15, the rod 30 is brought back to the initial position, in which it is coupled with the coupling portion 72*c* of the angled transmission element 26.

Figure 16:
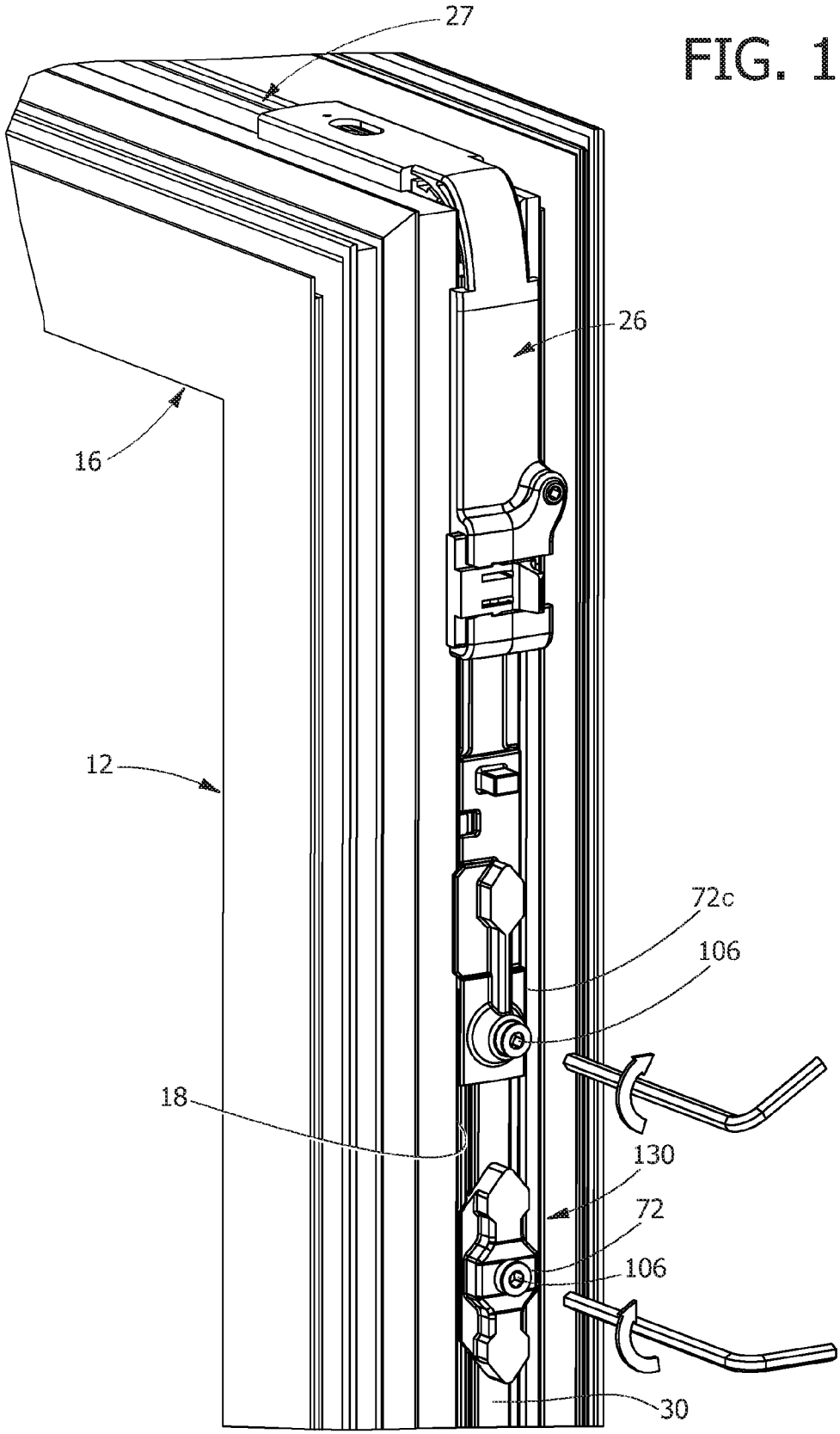

At this point, as shown in FIG. 16, the screw 106 of the angled transmission element 26 is screwed again. Said screw engages the through hole 118 already present on the rod 30.

The auxiliary member 130 is positioned on the rod 30 in the desired position where it is fastened by screwing the respective screw 106 all the way.

Figure 5:
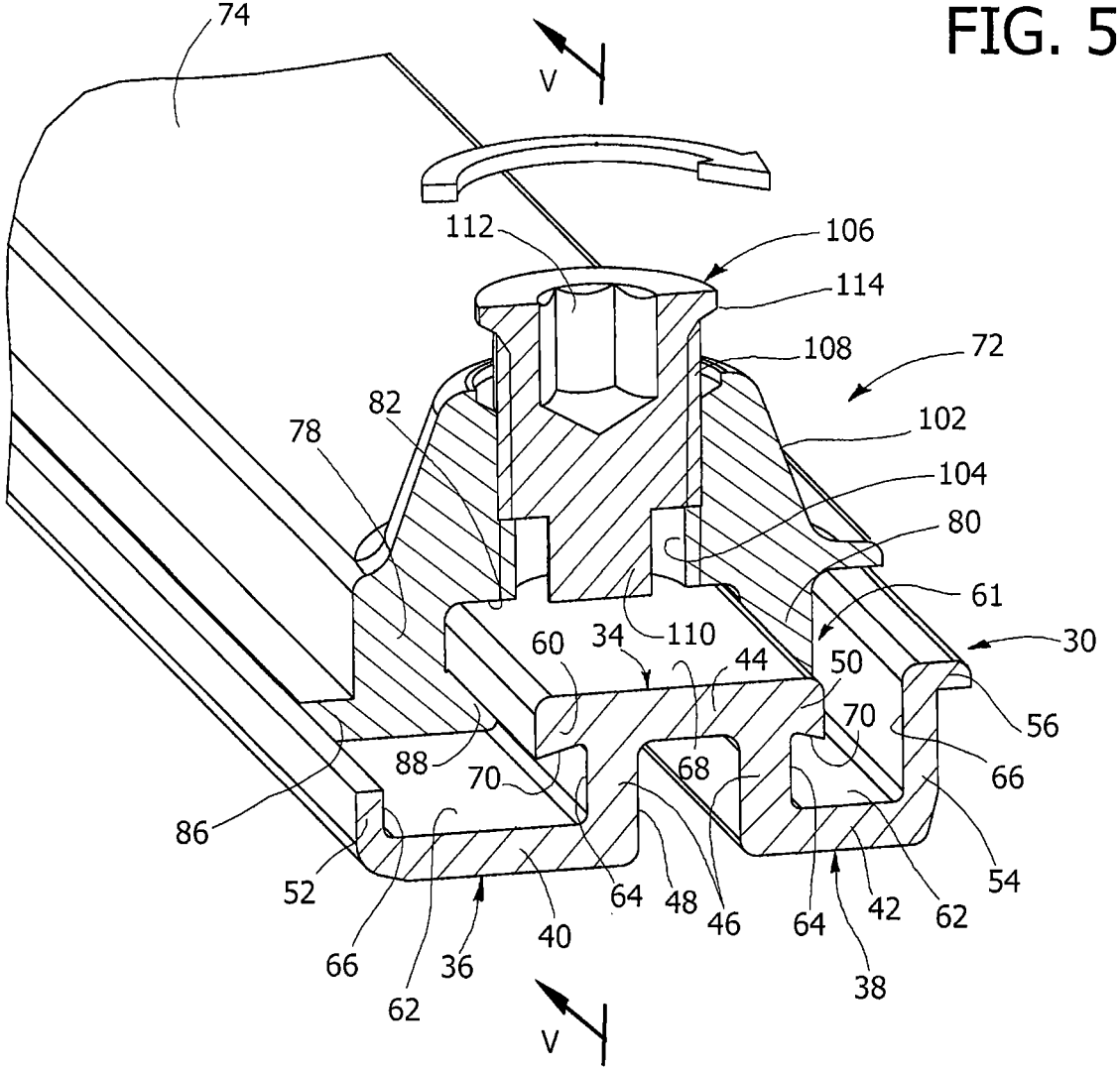
Figure 5B:
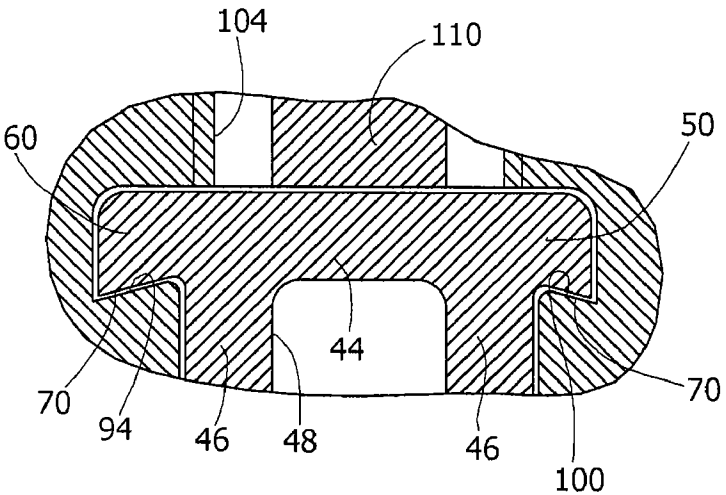
Figure 5A:
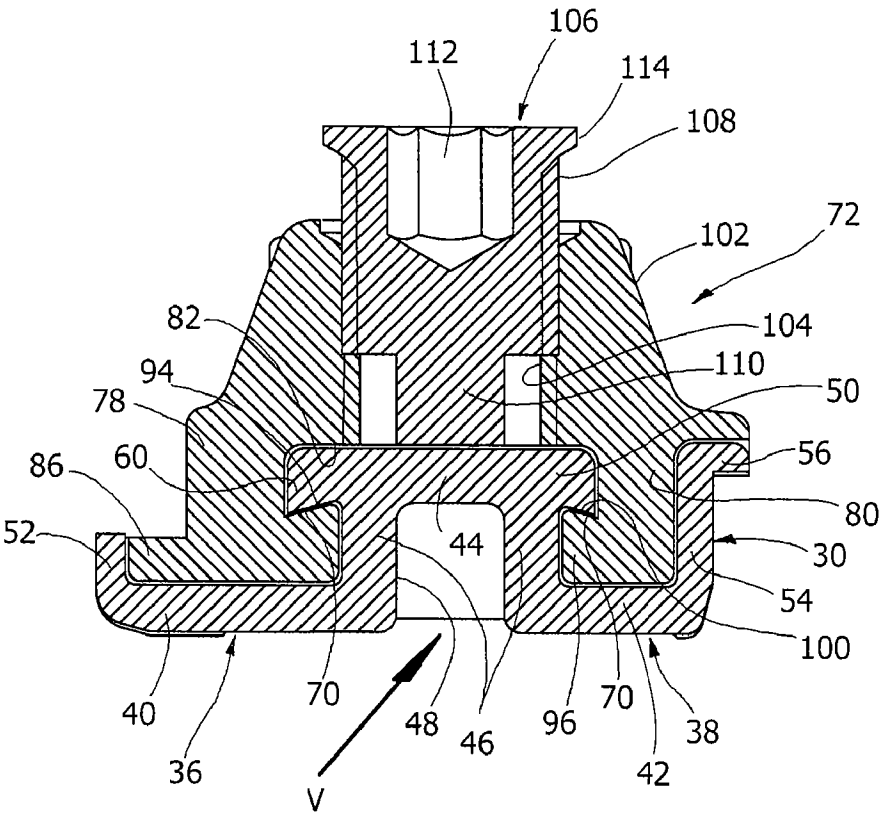

With reference to FIGS. 5, 5*a* and 5*b*, in the initial position the tip 110 of the screw 106 is slightly distanced from the upper surface 68 of the transmission rod 30, 32 and there is a play between the inclined surfaces 94, 100 of the coupling portion 72 and the corresponding surfaces 70 of the transmission rod 30. In this configuration, the auxiliary member 130 is free to slide relative to the transmission rod 30.

FIGS. 5 through 8 show the way in which the auxiliary member is fastened to the rod 30 by tightening the screw 106.

Beginning from the position shown in FIGS. 5, 5*a* and 5*b*, starting to tighten the screw 106 the tip 110 comes in contact with the upper surface 68 of the transmission rod 30, 32. This contact allows to eliminate the play of the telescopic coupling, bringing the inclined surfaces 94, 100 of the coupling portion 72 in contact with the corresponding surfaces 70 of the transmission rod 30, 32.

Figure 6:
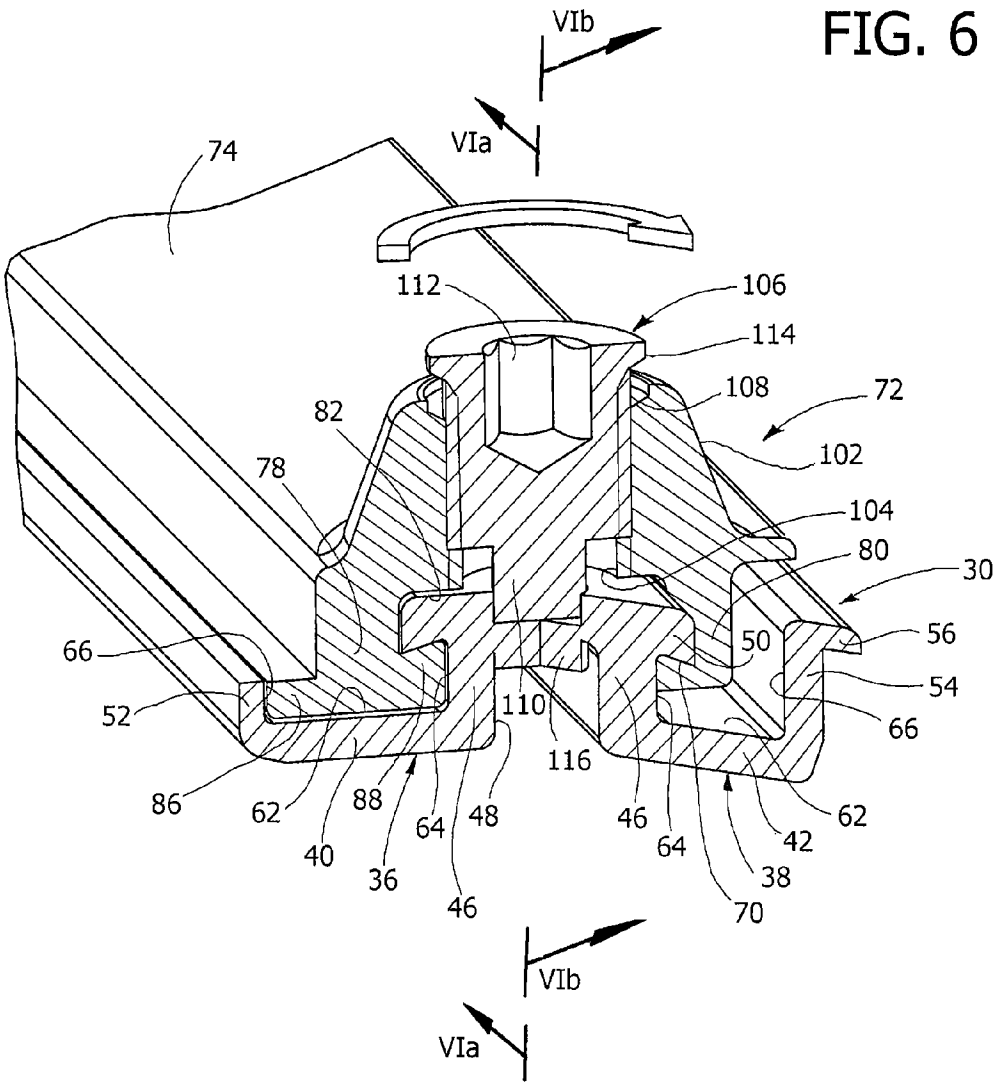
Figure 6B:
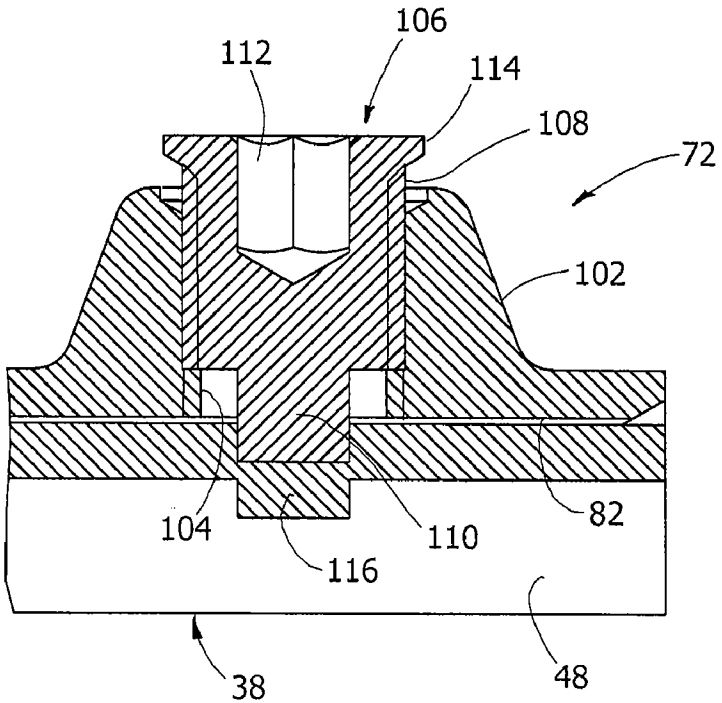
Figure 6A:
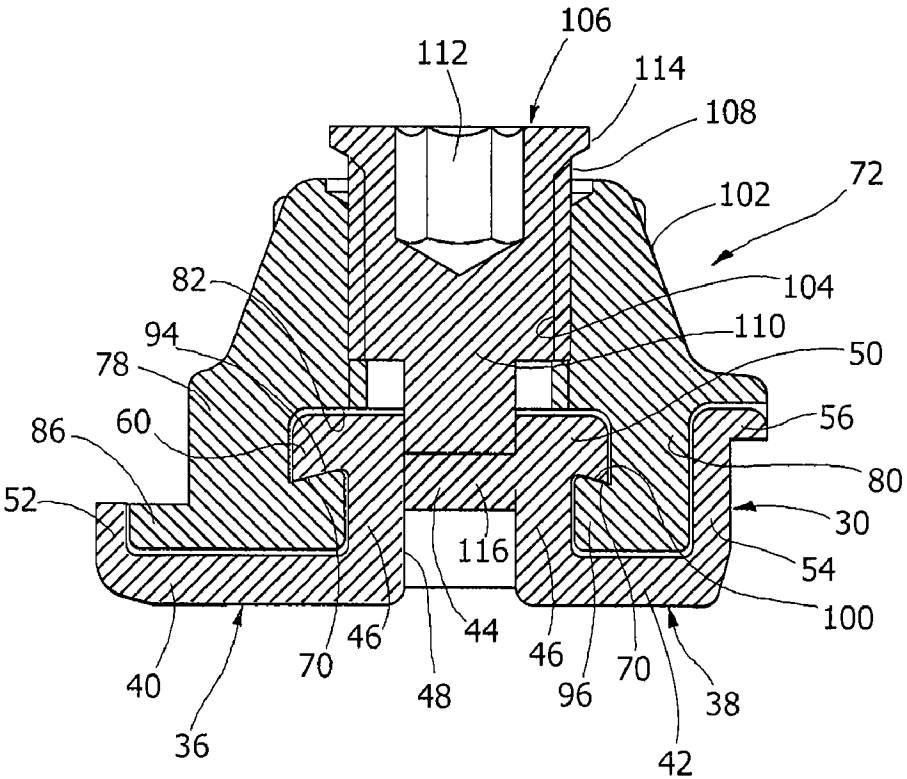

With reference to FIGS. 6, 6*a* and 6*b*, continuing to tighten the screw 106 the tip 110 starts to penetrate into the base 44 of the transmission rod 30, shearing the material constituting the base 44. Said shearing forms a disc-shaped scrap 116 that projects in the channel 48 situated below the tip 110. The diameter of the tip 110 is slightly greater than the width of the groove 48, so that the scrap remains wedged in the groove 48. The tip 110 is situated with its own axis aligned to the median vertical axis of the groove 48. The shearing performed by the tip 110 of the screw 106 affects only the thickness of the base 44 between the two lateral walls of the longitudinal groove 48.

Figure 7:
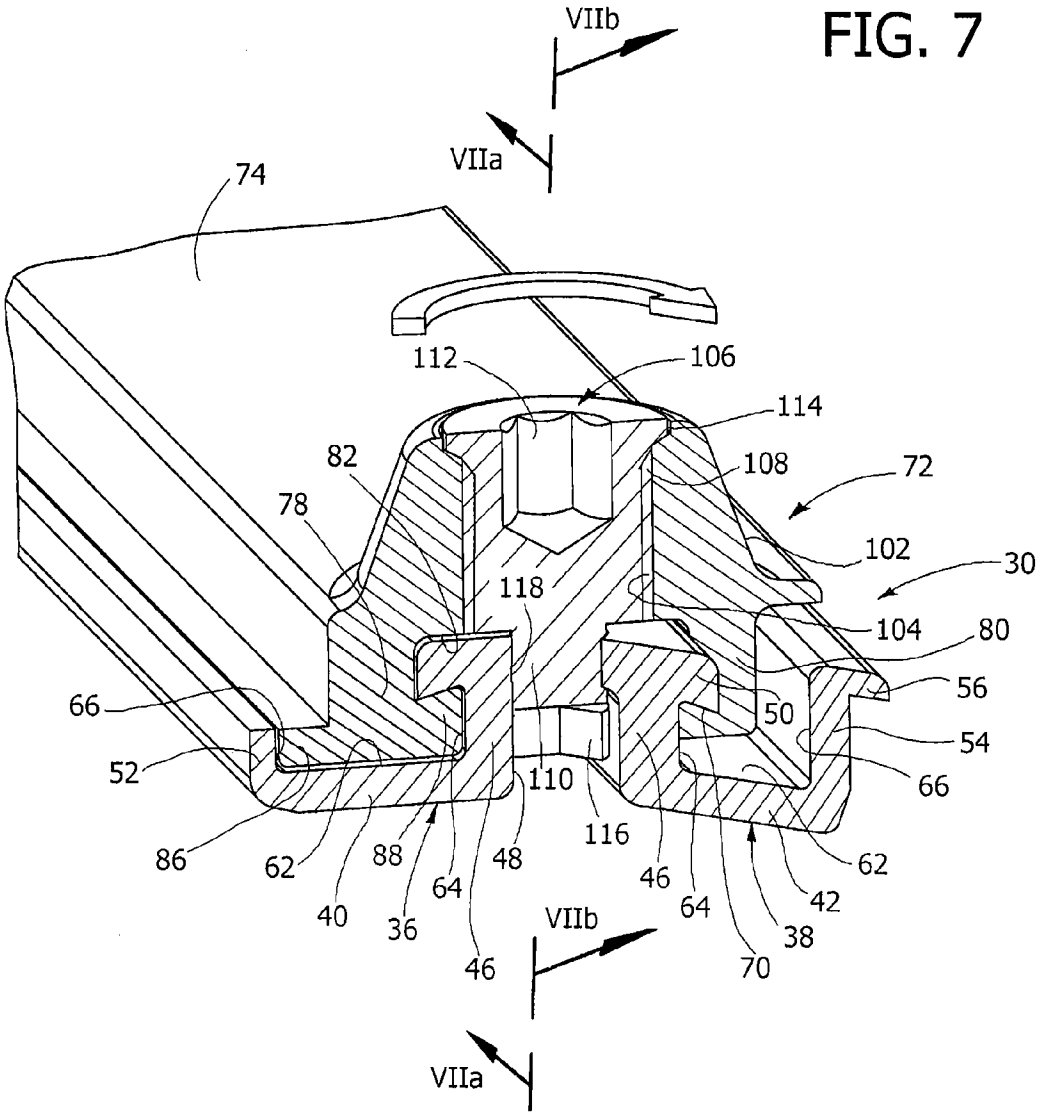
Figure 7B:
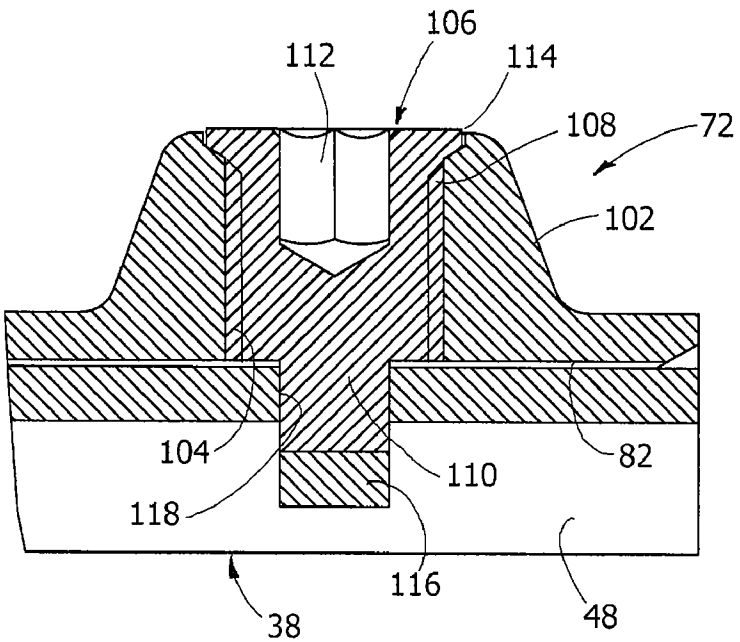
Figure 7A:
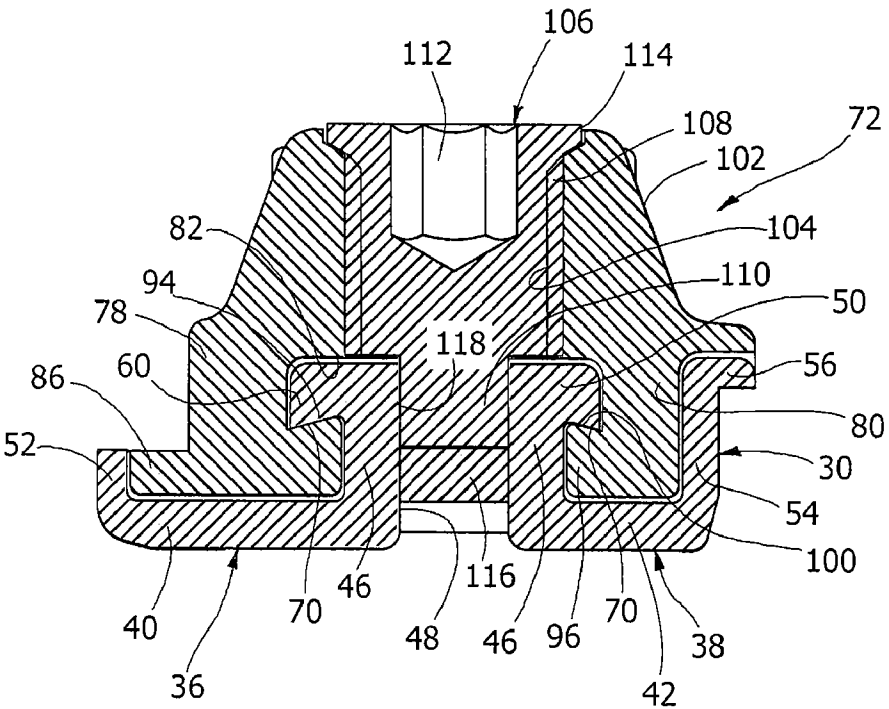

With reference to FIGS. 7, 7*a* and 7*b*, the screw 106 is screwed until the head 114 of the screw 106 abuts against the respective seat formed at the end of the section 102. The length of the tip 110 is determined in such a way that the screw 106 performs a complete shearing of the base 44, hence forming a through hole 118 in the base 44. The scrap 116 detaches from the base 44 and is held by interference between the walls of the groove 48.

Figure 8:
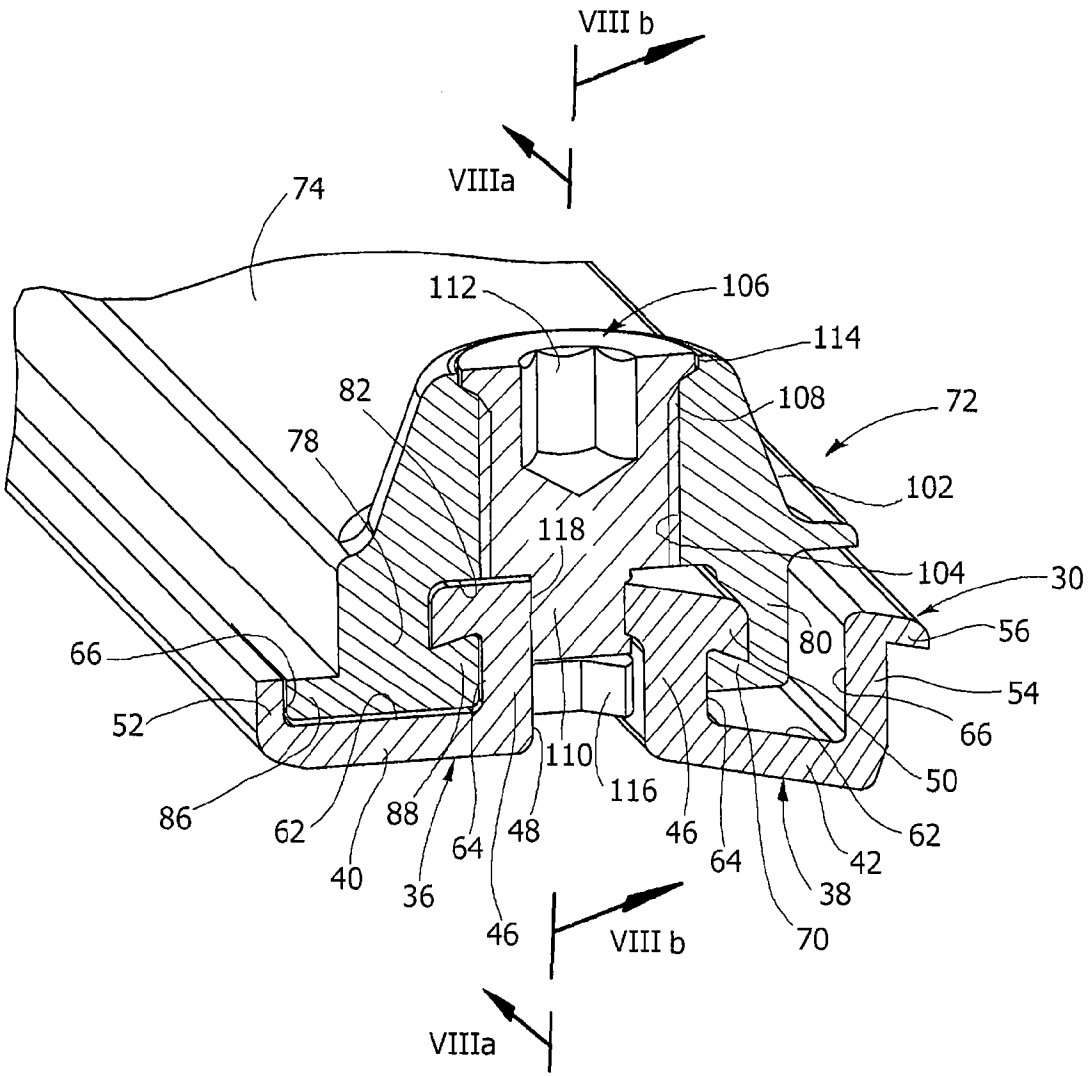
Figure 8B:
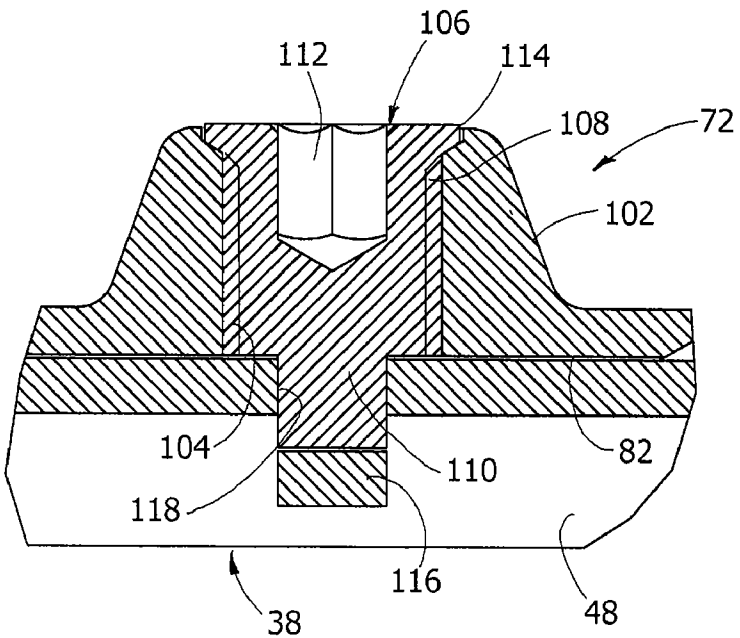
Figure 8A:
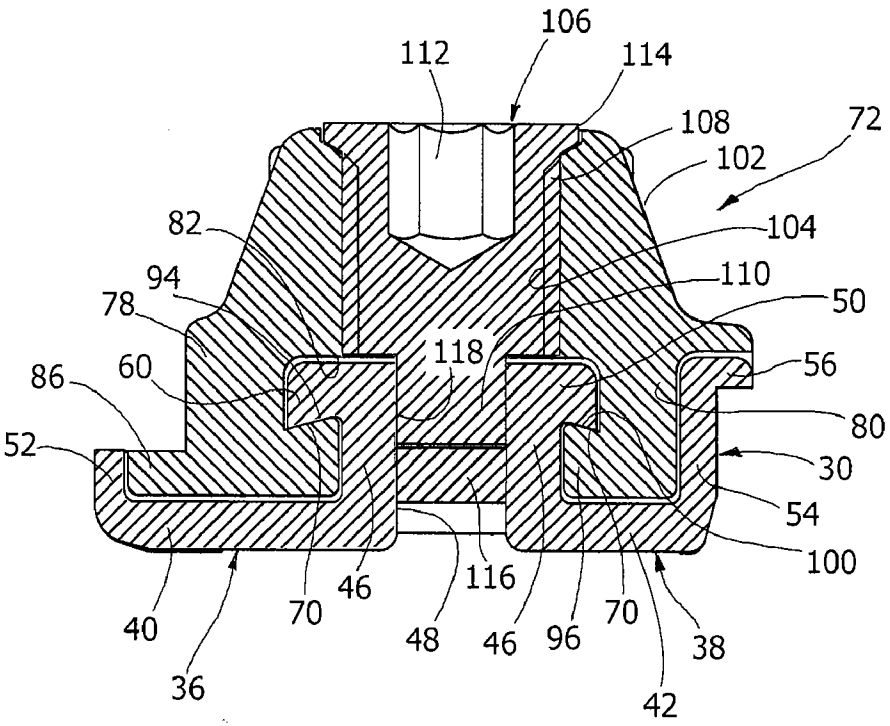

With reference to FIGS. 8, 8*a* and 8*b*, after the complete shearing of the wall of the base 44, the contact pressure between the inclined surfaces 94, 100 and 70 is eliminated. This allows to restore the initial play, eliminating the stresses and elastic deformations of the transmission rod 30.

After the shearing of the scrap 116, the coupling between the coupling portion 72 and the transmission rod 30, no longer takes place by friction but rather by pivot-hole coupling between the tip 110 of the screw 106 and the hole 118 created by effect of the shearing of the base 44. This enables to have a more secure fastening than in a friction coupling and enables to eliminate deformations of the transmission rod that could produce interference with the walls of the groove 18 of the frame 10 creating difficulties in the sliding of the rods or the actuating members and difficulties in operating the control assembly.

The fact of forming the hole in the rod 30 whilst the rod is in the final mounting position enables to avoid measuring, cutting and drilling the rod. The present invention therefore enables to mount auxiliary members on door and window frames already installed and with no need to use tools for cutting and drilling the rods, generally available only in the workshops of the manufacturers of the door and window frames.

While the foregoing is directed to embodiments of the present invention, other and further embodiments of the invention may be devised without departing from the basic scope thereof, and the scope thereof is determined by the claims that follow.

The invention claimed is:

1. A method for mounting an auxiliary member on a window or door frame and whereon is mounted a drive assembly comprising an actuating member and a transmission rod mounted in a slot of the frame, the method comprising:

slidably engaging the auxiliary member with the transmission rod, wherein the auxiliary member includes a threaded hole with a screw in a partially screwed position; and completely tightening said screw in the threaded hole of the auxiliary member thereby forming a non-threaded through hole with a smooth lateral wall in the transmission rod by a non-threaded tip of the screw which shears a base portion of the transmission rod as a result of screwing a threaded body of the screw in the threaded hole provided in the auxiliary member and fastening the auxiliary member to said transmission rod by the engagement of the non-threaded tip of said screw with said non-threaded through hole, wherein the non-threaded tip of said screw is a cylindrical body with a constant diameter wherein:

said transmission rod comprises a central portion and two lateral portions forming respective channel-shaped guides situated at opposite ends relative to the central portion, the central portion having two lateral extensions having inclined lower surfaces, said auxiliary member having a coupling portion comprising a body and two parallel longitudinal ribs projecting from the body, the longitudinal ribs having respective ends shaped so as to establish a sliding coupling in said channel-shaped guides, said ends of the longitudinal ribs having respective inner lateral extensions having inclined upper surfaces which contact said inclined lower surfaces when said screw is tightened for forming said non-threaded hole.

2. The method as claimed in claim 1, wherein said non-threaded through hole is formed after setting the relative position between said auxiliary member and said transmission rod in the direction of the respective slot.

3. The method as claimed in claim 1, wherein said channel-shaped guides of said transmission rod are slidably engaged with said longitudinal ribs of said auxiliary member.

4. The method as claimed in claim 1, wherein said non-threaded hole is formed by shearing a substantially flat end of said non-threaded tip as a result of screwing of the screw in the threaded hole provided in a coupling portion of said auxiliary member.

5. The method as claimed in claim 4, wherein said non-threaded tip produces a scrap that is retained between two lateral walls of a longitudinal channel of said transmission rod.

6. The method as claimed in claim 4, wherein the non-threaded tip of said screw penetrates into a wall of said transmission rod for a depth that is equal to or greater than the thickness of said wall.

7. The method as claimed in claim 5, wherein the diameter of said non-threaded tip is equal to or greater than the width of said longitudinal channel.

8. The method as claimed in claim 4, wherein the screw is screwed until reaching a contact between an arresting edge of the screw with a corresponding seat of said coupling portion.

* * * * *

UNITED STATES PATENT AND TRADEMARK OFFICE

CERTIFICATE OF CORRECTION

PATENT NO. : 8,205,392 B2
APPLICATION NO. : 11/763152
DATED : June 26, 2012
INVENTOR(S) : Aimone Balbo Di Vinadio It is certified that error appears in the above-identified patent and that said Letters Patent is hereby corrected as shown below:

Title Page:

Please insert

-- (30) Foreign Application Priority Data

Jun. 15, 2006 (IT) ..... TO2006A0434 --.

Signed and Sealed this
Thirteenth Day of August, 2013

Teresa Stanek Rea
*Acting Director of the United States Patent and Trademark Office*